US006946228B2

(12) United States Patent
Kanamaru et al.

(10) Patent No.: US 6,946,228 B2
(45) Date of Patent: Sep. 20, 2005

(54) TONER FOR DEVELOPMENT OF ELECTROSTATIC LATENT IMAGES

(75) Inventors: Yutaka Kanamaru, Wakayama (JP); Hidenori Tachi, Wakayama (JP); Shinji Moriyama, Wakayama (JP); Yoshihiro Fukushima, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/815,790

(22) Filed: Apr. 2, 2004

(65) Prior Publication Data

US 2004/0185364 A1 Sep. 23, 2004

Related U.S. Application Data

(63) Continuation of application No. 09/532,955, filed on Mar. 22, 2000, now abandoned.

(30) Foreign Application Priority Data

Mar. 24, 1999 (JP) ..... 11-80003

(51) Int. Cl.[7] ..... G03G 9/087

(52) U.S. Cl. ..... 430/108.4; 430/108.1; 430/109.4

(58) Field of Search ..... 430/109.4, 109.3, 430/108.4

(56) References Cited

U.S. PATENT DOCUMENTS 4,863,824 A * 9/1989 Uchida et al. ..... 430/109.4
5,629,122 A 5/1997 Tanikawa et al.
5,723,246 A * 3/1998 Aoki et al. ..... 430/109.4
5,840,456 A 11/1998 Tomita et al.
5,976,752 A * 11/1999 Matsunaga et al. ..... 430/109.4
6,168,894 B1 1/2001 Aoki et al.

FOREIGN PATENT DOCUMENTS

| | | | |
|---|---|---|---|
| JP | 63-225246 | A | 9/1988 |
| JP | 8-220808 | A | 8/1996 |
| JP | 9-106105 | A | 4/1997 |
| JP | 9-222750 | A | 8/1997 |
| JP | 11-24313 | A | 1/1999 |
| JP | 11-38677 | A | 2/1999 |

OTHER PUBLICATIONS

Japanese Abstract: JP07120976–A, May 12, 1995.
Japanese Abstract: JP05303236–A, Nov. 16, 1993.
Japanese Abstract: JP07064330–A, Mar. 10, 1995.
Japanese Abstract: JP07043945–A, Feb. 14, 1995.
Japanese Abstract: JP08320593–A, Dec. 3, 1996.

* cited by examiner

*Primary Examiner*—Christopher Rodee
(74) *Attorney, Agent, or Firm*—Birch, Stewart, Kolasch & Birch, LLP

(57) ABSTRACT

A toner for development of electrostatic latent images, comprising a resin binder comprising a resin having a softening point of from 120° to 170° C., a glass transition point of from 58° to 75° C., and a percentage of chloroform-insoluble component of from 5 to 50% by weight; and a resin having a softening point of 90° C. or more and less than 120° C., a glass transition point of from 58° to 75° C., and a percentage of chloroform-insoluble component of less than 5% by weight; and at least one low-melting point wax having a melting point of from 60° to 90° C. The toner for development of electrostatic latent images has low lowest fixing temperature and is excellent in the offset resistance, the blocking resistance and the durability.

4 Claims, No Drawings

TONER FOR DEVELOPMENT OF ELECTROSTATIC LATENT IMAGES

This application is a Continuation of application Ser. No. 09/532,955, filed on Mar. 22, 2000 now abandoned, and for which priority is claimed under 35 U.S.C. §120; and this application claims priority of Application No. 11-80003 filed in Japan on Mar. 24, 1999 under 35 U.S.C. §119; the entire contents of application Ser. No. 09/532,955 hereby incorporated by reference.

BACKGROUND OF THE INVENTION

1. Field of the Invention

The present invention relates to a toner for development of electrostatic latent images used for developing electrostatic latent images formed in electrophotography, electrostatic recording method, electrostatic printing, and the like.

2. Discussion of the Related Art

In order to prevent the offset phenomenon which is likely to be caused by heat roller fixing method, a widely employed fixing method for visible images, a toner comprising a wax has been developed. Japanese Patent Laid-Open No. 60-252366 discloses a toner comprising a resin binder comprising a polyester resin having a weight percentage of components insoluble to chloroform of 5% by weight or more, and carnauba wax, one of natural ester waxes, and a polyolefin wax. However, since the polyester resin and the wax contained in the toner have largely different melt viscosities, the homogeneous dispersion of the wax in the resin binder is difficult, so that the wax is exposed to the surface of the finely pulverized toner, thereby making the fluidity, the blocking resistance and the durability of the toner poor.

An object of the present invention is to provide a toner for development of electrostatic latent images having a low lowest fixing temperature and being excellent in the offset resistance, the blocking resistance and the durability.

The above object and other objects of the present invention will be apparent from the following description.

SUMMARY OF THE INVENTION

The present invention pertains to a toner for development of electrostatic latent images, comprising: a resin binder comprising:

(A) a resin having a softening point of from 120° to 170° C., a glass transition point of from 58° to 75° C., and a percentage of chloroform-insoluble component of from 5 to 50% by weight; and (B) a resin having a softening point of 90° C. or more and less than 120° C., a glass transition point of from 58° to 75° C., and a percentage of chloroform-insoluble component of less than 5% by weight; and at least one low-melting point wax having a melting point of from 60° to 90° C.

DETAILED DESCRIPTION OF THE INVENTION

The toner for development of electrostatic latent images comprises a resin binder comprising two or more resins, and at least one low melting point wax having a melting point of 60° to 90° C. Usually, when the high-softening point resin binder and the low-melting point wax are melt-kneaded, since the melt viscosities between the resin binder and the wax are largely different, it has been difficult to homogeneously disperse the low-melting point wax in the toner.

However, the toner of the present invention comprises at least two resins (A) and (B) having different softening points as a resin binder. Therefore, when these resin binders and the low-melting point wax are melt-kneaded, the resin having a low softening point acts as a compatibility-improver of the high-softening point resin and a low-melting point wax, thereby making it possible to homogeneously disperse the low-melting point wax in the resin binders.

In the present invention, in order to prepare a toner which sufficiently exhibits the excellent properties owned by each resin, thereby providing a toner which is excellent in all of the low-temperature fixing ability, the offset resistance, the blocking resistance and the durability, the physical properties and the compositional proportion of the resin (A) and the resin (B) are defined as follows.

The softening point of the resin (A) is 120° C. or more, from the viewpoints of the offset resistance and the durability, and the softening point is 170° C. or less, from the viewpoint of the lowest fixing temperature. The preferred softening point is from 130° to 165° C.

The glass transition point of the resin (A) is 58° C. or more, from the viewpoint of the blocking resistance, and the glass transition point is 75° C. or less, from the viewpoint of the lowest fixing temperature. The preferred glass transition point is from 58° to 70° C.

The weight percentage of components insoluble to chloroform of the resin (A) is 5% by weight or more, from the viewpoints of the offset resistance and the durability, and the weight percentage of components insoluble to chloroform is 50% by weight or less, from the viewpoint of the lowest fixing temperature. The preferred weight percentage is from 10 to 50% by weight. Incidentally, the term "weight percentage of components insoluble to chloroform" in the present invention refers to a weight percentage of resin components insoluble to chloroform at 25° C.

In order to increase the compatibility of the resin (A) with low-melting point wax, the softening point of the resin (B) is 90° C. or more and less than 120° C., preferably from 90° to 110° C.; the glass transition point is from 58° to 75° C., preferably from 58° to 70° C.; and the weight percentage of components insoluble to chloroform is less than 5% by weight, preferably from 0 to 3% by weight, more preferably 0% by weight.

The weight ratio of the resin (A) to the resin (B) is preferably from 10/90 to 90/10, more preferably from 20/80 to 80/20, still more preferably from 40/60 to 70/30.

Further, the resin binder used in the toner of the present invention may further comprise a resin (C), in addition to the resin (A) and resin (B). When the resin (C) is added, there can be obtained a resin binder having a wide molecular weight distribution which cannot be obtained by mixing only the two resins, the resin (A) and (B), so that the compatibility of the resin binder with the low-melting point wax is also improved, thereby making it possible to obtain a toner for development of electrostatic latent images being more excellent in the low-temperature fixing ability. In consideration of the above advantages, the resin (C) has a softening point of from 80° to 110° C., preferably from 90° to 110° C.; a glass transition point of 45° C. or more and less than 58° C., preferably 50° C. or more and less than 58° C.; a weight percentage of components insoluble to chloroform of less than 5% by weight, preferably from 0 to 3% by weight, more preferably 0% by weight.

The weight ratio of the resin (A) to a sum of the resin (B) and the resin (C) is preferably from 10/90 to 90/10, more preferably from 40/60 to 80/20, and the weight ratio of the resin (B) to the resin (C) is preferably from 10/90 to 90/10, more preferably from 40/60 to 80/20.

It is preferable that the difference in the softening points of the resin (A) with the resin (B) or the resin (C) is 20° C. or more, from the viewpoints of broadening the molecular weight distribution of the resin binder and improving the offset resistance and the low-temperature fixing ability. In addition, it is preferable that the difference in the softening point of the resin (B) or the resin (C) with the melting point of the low-melting point wax is 30° C. or less, from the viewpoint of the compatibility of the resin with the low-melting point wax.

Incidentally, each of the resins (A) to (C) explained above is preferably a polyester or a hybrid resin, from the viewpoints of the fixing ability, the durability and the colorant dispersibility. In addition, each of the resins (A) to (C) may comprise a single resin or an admixture of two or more resins. Therefore, for instance, the resin (A) may comprise two or more resins, and the same can be said for the resin (B) and the resin (C).

The polyester used in the present invention can be prepared by using the compounds exemplified in Japanese Patent Laid-Open No. 7-175260 (corresponding to U.S. Pat. No. 5,567,567) in reference to the process disclosed therein.

The raw material monomers of the polyester used are dihydric or higher polyhydric alcohol components and carboxylic acid components such as dicarboxylic or higher polycarboxylic acids, carboxylic acid anhydrides, and carboxylic acid esters.

Preferable dihydric alcohol components include alkylene (2 to 3 carbon atoms) oxide adducts of bisphenol A (average additional molar number: 1 to 10), ethylene glycol, propylene glycol, neopentyl glycol, 1,6-hexanediol, bisphenol A, hydrogenated bisphenol A, and the like.

Preferable trihydric or higher polyhydric alcohol components include sorbitol, 1,4-sorbitan, pentaerythritol, glycerol, trimethylolpropane, and the like.

In addition, the dicarboxylic acid components include various dicarboxylic acids; substituted succinic acids of which substituent is an alkyl group having 1 to 20 carbon atoms or an alkenyl group having 2 to 20 carbon atoms; acid anhydrides thereof; alkyl esters thereof of which alkyl moiety has 1 to 12 carbon atoms, and the like. The preferable dicarboxylic acid component is maleic acid, fumaric acid, terephthalic acid and a substituted succinic acid substituted by an alkenyl group having 2 to 20 carbon atoms.

The preferable tricarboxylic or higher polycarboxylic acid is 1,2,4-benzenetricarboxylic acid (trimellitic acid) and acid anhydrides thereof, alkyl esters thereof of which alkyl moiety has 1 to 12 carbon atoms.

When the raw material monomers of the polyester are polymerized, a usually employed esterification catalyst, or the like such as dibutyltin oxide may be used in an appropriate amount in order to accelerate the reaction.

The hybrid resin in the present invention is obtained, as described in Japanese Patent Laid-Open No. 8-171231 (corresponding to U.S. Pat. No. 5,677,100), by mixing a mixture of raw material monomers for two polymerization systems each having an independent reaction path, and carrying out two polymerization reactions in one reaction vessel.

The two polymerization reactions proceeds in independent reaction paths. In a preferable embodiment, each of the polymerization reactions is a reaction for forming a polycondensation resin or an addition polymerization resin. Representative examples of the polycondensation resin include polyesters, polyester-polyamides, polyamides and the like, and representative examples of the addition polymerization resin include vinyl polymerization resins obtained by radical polymerization reaction.

Among them, the polyester component can be obtained by polycondensation of raw material monomers of the dihydric or higher polyhydric alcohol component mentioned above and the carboxylic acid components such as dicarboxylic or higher polycarboxylic acids, carboxylic acid anhydrides, and carboxylic acid esters.

The raw material monomers used for forming amide components in the polyester-polyamides or the polyamides include various polyamines, amino carboxylic acids, and amino alcohols. Among them, preference is given to hexamethylenediamine and ϵ-caprolactam.

The raw material monomers used for forming the vinyl polymerization resins obtained by the addition polymerization include styrene; ethylenic unsaturated monoolefins such as ethylene and propylene; diolefins such as butadiene; ethylenic monocarboxylic acids such as (meth)acrylic acid; ethylenic monocarboxylic acid esters such as alkyl esters of (meth)acrylic acid, of which alkyl moiety has 1 to 18 carbon atoms, and the like.

It is preferred that the hybrid resin is obtained by the process comprising the steps of mixing raw material monomers of the polycondensation resin, raw material monomers of the addition polymerization resin and a polymerization initiator; firstly mainly obtaining the addition polymerization resin components by radical polymerization at 50° to 180° C., the resulting addition polymerization resin having functional groups with which polycondensation reaction can be carried out; and subsequently raising the reaction temperature to 190° to 270° C. and mainly forming the polycondensation resin component by polycondensation reaction. By employing a process in which two independent reactions are proceeded in one reaction vessel as described above, a hybrid resin in which the compatibility of the two kinds of resins is notably improved can be efficiently obtained.

It is desired that the weight ratio of the polycondensation resin to the addition polymerization resin, i.e. the weight ratio of the raw material monomers of the polycondensation resin to the raw material monomers of the addition polymerization resin, is usually from 50/50 to 95/5, preferably from 60/40 to 95/5, from the viewpoint of the dispersibility of the addition polymerization resin.

Incidentally, each of the physical properties of the resins (A) to (C) mentioned above, namely the softening point, the glass transition point, and the weight percentage of components insoluble to chloroform may be easily adjusted by the kinds of the raw material monomers when preparing each resin, the polymerization initiator or the catalyst, and amounts thereof, and the selection of the reaction conditions.

The resin binder used in the present invention may be those comprising a simple mixture of powdery or pelletal forms of the resins (A) and (B) or the resins (A) to (C). Alternatively, these resins may be homogeneously mixed and dispersed by melt-kneading, and thereafter pulverizing, to give powdery or pelletal forms.

The low-melting point wax used in the toner of the present invention includes plant-derived waxes such as carnauba wax, rice wax and candelilla wax; synthetic waxes such as Fischer-Tropsch wax and ester waxes; petroleum waxes such as paraffin waxes, microcrystalline wax and petrolactam; oxidized waxes thereof, such as oxidized paraffin waxes. These low-melting point waxes may be used alone or in admixture of two or more kinds. In addition, among them, carnauba wax, rice wax and candelilla wax are preferable, and the carnauba wax is more preferable.

The melting point of the low-melting point wax is 60° C. or more, from the viewpoint of the blocking resistance, and the melting point is 90° C. or less, from the viewpoint of the low-temperature fixing ability. The preferred melting point is from 70° to 85° C. In the present invention, a high-melting point wax having a melting point exceeding 90° C., such as a polypropylene wax may be admixed, but it is desirable that the amount of the low-melting point wax is 30% by weight or more, preferably 50% by weight or more, more preferably 80% by weight or more, in the entire wax component, from the viewpoint of the lowest fixing temperature and the durability. Incidentally, in the present invention, the term "melting point of the wax" in the present invention refers to a temperature at top of an endothermic peak obtained when determining with a differential scanning calorimeter "DSC 210" (manufactured by Seiko Instruments, Inc.), at a heating rate of 10° C./min.

The content of the low-melting point wax is preferably from 1 to 10 parts by weight, more preferably from 1 to 6 parts by weight, based on 100 parts by weight of the resin binder, from the viewpoints of the blocking resistance, the low-temperature fixing ability and the durability.

The toner for development of electrostatic latent images of the present invention can be produced by a known method such as a kneading-pulverization method, a spray-drying method, or a polymerization method. A general method includes a process comprising, for instance, homogeneously mixing a resin binder, a wax, and the like in a mixer such as a ball-mill, thereafter melt-kneading with a closed kneader or a single-screw or twin-screw extruder, cooling, pulverizing and classifying the product. Further, a fluidity improver and the like may be added to the surface of the toner as occasion demands. The weight-average particle size of the resulting toner is preferably from 5 to 15 $\mu$m.

The toner for development of electrostatic latent images of the present invention may further comprise in appropriate amounts additives such as colorants, charge control agents, electric conductivity modifiers, extenders, reinforcing fillers such as fibrous substances, antioxidants, anti-aging agents, fluidity improvers, and cleanability improvers.

As the colorants, all of the dyes and pigments which are used as conventional colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants may be used alone or in admixture of two or more kinds. The content of the colorant is preferably from 1 to 10 parts by weight, based on 100 parts by weight of the resin binder.

The toner for development of electrostatic latent images of the present invention can be used alone as a developer, in a case where the fine magnetic material powder is contained; or the toner used as a nonmagnetic one-component developer, or the toner can be mixed with a carrier as a two-component developer, in a case where the fine magnetic material powder is not contained.

EXAMPLES

Softening Point

The temperature at which one-half of resin flows out, when measured by using a flow tester of the "koka" type (Model "CFT-500" manufactured by Shimadzu Corporation) [sample: 1 g, heating rate: 6° C./min, applied load: 1.96 MPa, nozzle: 1 mm diameter and a length of 1 mm].

Glass Transition Temperature

Determined at a heating rate of 10° C./min by using a differential scanning calorimeter ("DSC Model 210," manufactured by Seiko Instruments, Inc.).

Weight Percentage of Components Insoluble to Chloroform

A 100 cc-glass bottle equipped with a screw cap is charged with 5 g of a resin powder, 5 g of "RADIOLITE #700" (manufactured by Showa Kagaku Kogyo K.K.) and 100 ml of chloroform, and the ingredients are stirred in a ball-mill at 25° C. for 5 hours, to give a resin liquid mixture. Thereafter, a filter paper (No. 2 Paper, manufactured by Toyo Roshi Kaisha, Ltd.) having a diameter of 70 mm is placed on a pressure filtration device made of stainless steel, and 5 g of RADIOLITE is evenly packed thereon and subjected to pressure filtration.

Subsequently, the solids on the filter paper are washed twice with 100 ml of chloroform, and then the solids are subjected to drying. Further, a weight percentage of components insoluble to chloroform is calculated according to the following equation:

$$\text{Weight Percentage of Insoluble Components (\% by weight)} = \frac{\text{Weight (g) of Solids on Filter Paper} - \text{Weight of RADIOLITE (10 g)}}{5\text{ g}} \times 100$$

Preparation Examples of Polyesters (A-1, A-2, B-1, B-3, B-4, C-1 and C-2)

The raw materials for each of the polycondensation resins shown in Table 1 were reacted at 220° C. under nitrogen atmosphere, and the reaction was terminated when the softening point as determined by ASTM E28-67 reached a given temperature. The reaction mixture was cooled and pulverized, to give each of Polyesters A-1, A-2, B-1, B-3, B-4, C-1 and C-2. The softening point, the glass transition point, and the weight percentage of components insoluble to chloroform of each of the resulting resins are shown in Table 2.

Preparation Examples of Polyesters (A-5 and B-5)

The raw materials for each of the polycondensation resins shown in Table 1 were reacted for 8 hours in a reactor equipped with a dehydration tube comprising a distillation tower through which hot water at 100° C. was allowed to flow, with heating to a temperature of from 180° to 210° C. The reaction was terminated when the softening point as determined by ASTM E28-67 reached a given temperature. The reaction mixture was cooled and pulverized, to give each of Polyesters A-5 and B-5. The softening point, the glass transition point, and the weight percentage of components insoluble to chloroform of each of the resulting resins are shown in Table 2.

Preparation Examples of Hybrid Resins (A-3, A-4, B-2, C-3 and C-4)

With stirring the raw materials for each of the polycondensation resins shown in Table 1 at 135° C. under nitrogen atmosphere, the raw material mixture of each of the addition polymerization resin shown in Table 1 was added dropwise thereto over a period of 4 hours. The resulting reaction mixture was matured for 5 hours, with keeping the temperature at 135° C. The ingredients were heated to 230° C. to proceed with the reaction, and the reaction was terminated when the softening point as determined by ASTM E28-67 reached a given temperature. The reaction mixture was cooled and pulverized, to give each of Polyesters A-3, A-4, B-2, C-3 and C-4. The softening point, the glass transition point, and the weight percentage of components insoluble to chloroform of each of the resulting resins are shown in Table 2.

TABLE 1

| | Raw Material for Polycondensation Resin | | | | | | | |
|---|---|---|---|---|---|---|---|---|
| No. | BPA.PO | BPA.EO | EG | NPG | H-BPA | i-DSA | TPA | TMA |
| A-1 | 350 g<br>1.0 mol | 325 g<br>1.0 mol | | | | 54 g<br>0.2 mol | | 58 g<br>0.3 mol |
| A-2 | 490 g<br>1.4 mol | 195 g<br>0.6 mol | | | | 108 g<br>0.4 mol | 166 g<br>1.0 mol | 58 g<br>0.3 mol |
| A-3 | 35 g<br>0.1 mol | 618 g<br>1.9 mol | | | | | 249 g<br>1.5 mol | 38 g<br>0.2 mol |
| A-4 | 700 g<br>2.0 mol | 33 g<br>0.1 mol | | | | 134 g<br>0.5 mol | 166 g<br>1.0 mol | 96 g<br>0.5 mol |
| A-5 | | | 200 g<br>3.2 mol | 600 g<br>5.8 mol | | | 950 g<br>5.7 mol | 350 g<br>1.8 mol |
| B-1 | 700 g<br>2.0 mol | 650 g<br>2.0 mol | | | | 108 g<br>0.4 mol | 498 g<br>3.0 mol | 116 g<br>0.6 mol |
| B-2 | 490 g<br>1.4 mol | 195 g<br>0.6 mol | | | | 54 g<br>0.2 mol | 265 g<br>1.6 mol | 38 g<br>0.2 mol |
| B-3 | 700 g<br>2.0 mol | | | | | 54 g<br>0.2 mol | 249 g<br>1.5 mol | 58 g<br>0.3 mol |
| B-4 | 140 g<br>0.4 mol | 1236 g<br>3.8 mol | | | | 108 g<br>0.4 mol | 332 g<br>2.0 mol | 76 g<br>0.4 mol |
| B-5 | | | | 780 g<br>7.5 mol | 180 g<br>0.8 mol | | 1150 g<br>6.9 mol | 350 g<br>1.8 mol |
| C-1 | 980 g<br>2.8 mol | 195 g<br>0.6 mol | | | | | 249 g<br>1.5 mol | 38 g<br>0.2 mol |
| C-2 | 70 g<br>0.2 mol | 1236 g<br>3.8 mol | | | | 134 g<br>0.5 mol | 498 g<br>3.0 mol | 58 g<br>0.3 mol |
| C-3 | 700 g<br>2.0 mol | 325 g<br>1.0 mol | | | | 54 g<br>0.2 mol | 332 g<br>2.0 mol | 58 g<br>0.3 mol |
| C-4 | 1050 g<br>3.0 mol | | | | | | 481 g<br>2.9 mol | 38 g<br>0.2 mol |

| | Raw Material for Polycondensation Resin | | | | Raw Material for Addition Polymerization Resin | | | |
|---|---|---|---|---|---|---|---|---|
| No. | AA | FA | HMDA | DBO | St | EHA | n-BA | DCP |
| A-1 | | 211 g<br>1.8 mol | | 3 g<br>12 mmol | | | | |
| A-2 | | | 23 g<br>0.2 mol | 3 g<br>12 mmol | | | | |
| A-3 | | 35 g<br>0.3 mol | | 3 g<br>12 mmol | 416 g<br>4.0 mol | | 130 g<br>1.0 mol | 20 g<br>0.08 mol |
| A-4 | 7 g<br>0.1 mol | | | 3 g<br>12 mmol | 208 g<br>2.0 mol | 34 g<br>0.2 mol | | 20 g<br>0.08 mol |
| A-5 | | | | 2 g<br>8 mmol | | | | |
| B-1 | | | | 6 g<br>24 mmol | | | | |
| B-2 | 28 g<br>0.4 mol | | | 3 g<br>12 mmol | 208 g<br>2.0 mol | 34 g<br>0.2 mol | | 20 g<br>0.08 mol |
| B-3 | | 23 g<br>0.2 mol | 23 g<br>0.2 mol | 3 g<br>12 mmol | | | | |
| B-4 | | 46 g<br>0.4 mol | | 6 g<br>24 mmol | | | | |
| B-5 | | | | 2 g<br>8 mmol | | | | |
| C-1 | | 211 g<br>1.8 mol | | 3 g<br>12 mmol | | | | |
| C-2 | | | | 3 g<br>12 mmol | | | | |
| C-3 | | 59 g<br>0.5 mol | | 3 g<br>12 mmol | 208 g<br>2.0 mol | 34 g<br>0.2 mol | | 20 g<br>0.08 mol |
| C-4 | 7 g<br>0.1 mol | | | 3 g<br>12 mmol | 312 g<br>3.0 mol | 68 g<br>0.4 mol | | 20 g<br>0.08 mol |

In Tables 1 and 2, the following abbreviations are used.

BPA•PO: Polyoxypropylene(2.2)-2,2-bis(4-hydroxyphenyl)propane

BPA•EO: Polyoxyethylene(2.2)-2,2-bis(4-hydroxyphenyl)propane

EG: Ethylene glycol

NPG: Neopentyl glycol

H-BPA: Hydrogenated bisphenol A i-DSA: Isododecenylsuccinic acid anhydride

TPA: Terephthalic acid

TMA: 1,2,4-Benzenetricarboxylic acid anhydride (trimellitic acid anhydride)

AA: Acrylic acid (monomer which reacts with both polymerization resins)

FA: Fumaric acid (monomer which reacts with both polymerization resins)

HMDA: Hexamethylenediamine

DBO: Dibutyltin oxide

St: Styrene

EHA: 2-Ethylhexyl acrylate n-BA: n-Butyl acrylate

DCP: Dicumyl peroxide (polymerization initiator)

TABLE 2

| No. | Softening Point (° C.) | Glass Transition Temperature (° C.) | Weight Percentage of Components Insoluble to Chloroform (% by weight) |
|---|---|---|---|
| A-1 | 144 | 62 | 22 |
| A-2 | 139 | 60 | 16 |
| A-3 | 151 | 64 | 25 |
| A-4 | 162 | 62 | 29 |
| A-5 | 143 | 65 | 14 |
| B-1 | 106 | 60 | 0 |
| B-2 | 101 | 61 | 0 |
| B-3 | 103 | 59 | 0 |
| B-4 | 96 | 58 | 0 |
| B-5 | 109 | 59 | 0 |
| C-1 | 89 | 52 | 0 |
| C-2 | 95 | 54 | 0 |
| C-3 | 105 | 56 | 0 |
| C-4 | 100 | 51 | 0 |

Examples 1 to 11 and Comparative Examples 1 to 4

Resin binders with combinations and amounts shown in Table 3, a total amount of the binder resins being 100 parts by weight, a wax in an amount shown in Table 3, 7 parts by weight of a carbon black "MOGUL L" (manufactured by Cabot Corporation), and 1 part by weight of a charge control agent "BONTRON S-34" (manufactured by Orient Chemical Co., Ltd.) were previously blended, and then the resulting mixture was melt-blended using a twin-screw extruder. After the extruded product was cooled, the product was subjected to pulverization and classification in a conventional manner, to give each of an untreated toner having an average particle size of 10 μm.

The amount 0.3 parts by weight of a hydrophobic silica "H-2000" (manufactured by Wacker Chemical Co.) was blended with 100 parts by weight of each of the resulting untreated toners by using a Henschel mixer to give each of the toners.

A developer was prepared by blending 39 parts by weight of each of the toners with 1261 parts by weight of spherical ferrite powder coated with styrene-methyl methacrylate resin (average particle size: 100 μm).

Test Example 1

Each of the developers prepared as described above was loaded on a copy machine [a modified apparatus of "SF9800" (manufactured by Sharp Corporation) which was equipped with an amorphous selene photoconductor and a fixing roller having a rotational speed of 265 mm/sec, set to have variable heat roller temperatures, and an oil applying device being removed therefrom]. By sequentially increasing the fixing roller temperature from 90° C. to 240° C., the formed images were developed to determine the lowest fixing temperature and the hot offset generating temperature by the following methods. The results are shown in Table 3.

(1) Lowest Fixing Temperature

The lowest fixing temperature used herein referred to the temperature of the fixing roller at which the fixing ratio of the toner exceeded 70%. This fixing ratio of the toner was determined by placing a load of 500 g on a sand-rubber eraser (LION No. 502) having a bottom area of 15 mm×7.5 mm on a fixed toner image obtained in the fixing device, moving the loaded eraser on the image backward and forward five times, measuring the optical reflective density of the image before or after the eraser treatment with a reflective densitometer "RD-915" manufactured by Macbeth Process Measurements Co., and then calculating the fixing ratio by the following equation.

$$\text{Fixing Ratio} = \frac{\text{Optical density after eraser treatment}}{\text{Optical density before eraser treatment}} \times 100$$

(2) Hot-Offset Generating Temperature

Fixed images were developed at each temperature, and subsequently blank image-transfer paper was conveyed through the fixing roller under the same conditions as above. The "hot offset generating temperature" is referred to a temperature of the fixing roller at which toner dusts were initially generated on the blank paper.

Test Example 2

A 100 ml glass bottle was charged with 10 g of each toner, and the blocking resistance was evaluated after the toners were allowed to stand under the conditions of 50° C. temperature and 26% relative humidity for two weeks in accordance with the following evaluation criteria:

○: Completely no blocking was observed.

x: Toner was in a hard caking state.

The results are shown in Table 3.

The life of the developer was defined as the instance at which the background on the white portion of the printed paper can be visibly confirmed by continuously copying with a copy machine ("SF9800" manufactured by Sharp Corporation) using an A4 copy sheet having a blackened proportion of 5%, and the number of copies printed until reaching this point is a measure of the durability. Incidentally, the maximum copies were set at 150,000. The results are shown in Table 3.

TABLE 3

| | Resin Binder/Amount (Parts by weight) | | | Wax[1)]/Amount (Parts by weight) | | Lowest Fixing Temp. | Hot Offset Generating Temp.[2)] | Blocking Resistance | Durability (×1000 sheets) |
|---|---|---|---|---|---|---|---|---|---|
| | Resin (A) | Resin (B) | Resin (C) | Low-Melting Point Wax | High-Melting Point Wax | (° C.) | (° C.) | | |
| Example No. | | | | | | | | | |
| 1 | A-1/50 | B-1/50 | — | Rice Wax/3 | — | 102 | 240< | ○ | 150 |
| 2 | A-2/60 | B-2/40 | — | Candelilla Wax/3 | — | 103 | 240< | ○ | 150 |
| 3 | A-3/50 | B-3/50 | — | Carnauba Wax/3 | — | 99 | 240< | ○ | 150 |
| 4 | A-4/45 | B-4/55 | — | Rice Wax/2 | Polypropylene Wax/2 | 104 | 240< | ○ | 135 |
| 5 | A-4/45 | B-4/55 | — | Candelilla Wax/2 Carnauba Wax/2 | — | 98 | 240< | ○ | 150 |
| 6 | A-1/50 | B-1/30 | C-1/20 | Rice Wax/3 | — | 99 | 240< | ○ | 150 |
| 7 | A-2/60 | B-2/30 | C-2/10 | Candelilla Wax/3 | — | 100 | 240< | ○ | 150 |
| 8 | A-3/50 | B-3/30 | C-4/20 | Carnauba Wax/3 | — | 95 | 240< | ○ | 150 |
| 9 | A-4/45 | B-4/35 | C-3/20 | Rice Wax/2 | Polypropylene Wax/2 | 102 | 240< | ○ | 135 |
| 10 | A-1/50 | B-5/50 | — | Rice Wax/3 | — | 101 | 240< | ○ | 150 |
| 11 | A-5/45 | B-5/55 | — | Carnauba Wax/3 | — | 102 | 240< | ○ | 150 |
| Comp. Example No. | | | | | | | | | |
| 1 | A-2/60 | B-2/40 | — | — | Polypropylene Wax/2 | 125 | 240< | ○ | 125 |
| 2 | A-1/50 | — | C-3/50 | Rice Wax/3 | — | 100 | 240< | X | 100 |
| 3 | — | B-1/80 | C-1/20 | Rice Wax/3 | — | 92 | 145 | X | 50 |
| 4 | A-2/60 | B-2/30 | C-2/10 | — | Polypropylene Wax/2 | 118 | 240< | ○ | 120 |

Remarks on Table 3:
[1)]Rice Wax: "M-90" [manufactured by K.K. Serarika-Noda, melting point: 78.2° C.]
Candellila Wax: "Candellila Wax No. 1" [manufactured by K.K. Serarika-Noda, melting point: 69.8° C.]
Carnauba Wax: "Carnauba Wax No. 1" [manufactured by K.K. Kato Yoko, melting point: 83.6° C.]
Polypropylene Wax: "Viscol 660P" [manufactured by Sanyo Chemical Industries, Ltd., melting points: 135° C., 144° C. (2 peaks detected by DSC)]
[2)]"240<" means that no offset is generated at 240° C.

As is clear from the above results, all of the toners of Examples 1 to 11 had a low lowest fixing temperature, and are excellent in all of the offset resistance, the blocking resistance and the durability, and especially the toners of Examples 6 to 9 containing resin (C) in the present invention has an even lower lowest fixing temperature. On the other hand, there are respectively elucidated that in the case of the toners of Comparative Examples 1 and 4 where only the high-melting point wax was used, the resulting toner had high lowest fixing temperature and was poor in the durability; in the case of the toner of Comparative Example 2 where no resin (B) was contained, the resulting toner was poor in the blocking resistance and the durability; and in the case of the toner of Comparative Example 3 where no resin (A) was used, the resulting toner was poor in the offset resistance, the blocking resistance and the durability.

According to the present invention, there can be provided a toner for development of electrostatic latent images having low lowest fixing temperature and being excellent in the offset resistance, the blocking resistance and the durability.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for development of electrostatic latent images, comprising a resin binder consisting of:

(A) a polyester having a softening point of from 120° to 170° C., a glass transition point of from 58° to 75° C., and a percentage of chloroform-insoluble component of from 5 to 50% by weight;

(B) a polyester having a softening point of 90° C. or more and less than 120° C., a glass transition point of from 58° to 75° C., and a percentage of chloroform-insoluble component of less than 5% by weight; and (C) at least one low-melting point wax having a melting point of from 60° to 90° C., selected from the group consisting of carnauba wax, rice wax, and candelilla wax;

wherein the low melting point wax is present in an amount of from 1 to 6 parts by weight based on 100 parts by weight of the resin binder, and wherein a weight ratio of said polyester (A) to said polyester (B) is from 40/60 to 70/30.

2. The toner for development of electrostatic latent images according to claim 1, the difference in the softening points of the polyester (A) with the polyester (B) is 20° C. or more.

3. The toner for development of electrostatic latent images according to claim 1, the difference in the softening point of the polyester (B) with the melting point of the low-melting point wax is 30° C. or lees.

4. The toner for development of electrostatic latent images, according to claim 1 wherein a weight ratio of said polyester (A) to said polyester (B) is from 45/55 to 60/40.

* * * * *